United States Patent [19]

Ketcham et al.

[11] Patent Number: 4,870,706

[45] Date of Patent: Oct. 3, 1989

[54] SPORTS PROTECTION GARMENT

[75] Inventors: Kenneth E. Ketcham, 1192 Broadway; John Barry, 1193 Broadway, both of Masury, Ohio 44438; David V. Hofius, Sharon, Pa.

[73] Assignees: Kenneth E. Ketcham; John Barry, both of Masury, Ohio

[21] Appl. No.: 190,679

[22] Filed: May 5, 1988

[51] Int. Cl.[4] ..... A41D 13/00

[52] U.S. Cl. ..... 2/2; 128/DIG. 20; 2/DIG. 3

[58] Field of Search ..... 2/2, 2.5, DIG. 3; 128/DIG. 20

[56] References Cited

U.S. PATENT DOCUMENTS

| | | | |
|---|---|---|---|
| 2,607,934 | 8/1952 | Bailhe | 2/DIG. 3 |
| 3,530,159 | 12/1970 | Alarco | 2/2 |
| 3,995,320 | 12/1976 | Zafuto | 2/2 |
| 4,067,063 | 1/1978 | Ettinger | 2/16 |
| 4,168,063 | 9/1979 | Rowland | 128/DIG. 20 |
| 4,213,202 | 7/1980 | Larry | 2/2 |
| 4,384,369 | 5/1983 | Prince | 2/81 |

*Primary Examiner*—Ronald Feldbaum

*Attorney, Agent, or Firm*—Harpman & Harpman

[57] ABSTRACT

A sports protection garment for use by athletes to provide adjustable upper body protection. Separate configured air inflatable multiple chambered pads are positioned in multiple fabric compartments strategically located on a lightweight fabric garment covering the athlete's upper body. Each of the multiple chambered pads is independent and can be removed from its matching compartment for replacement or repair.

3 Claims, 1 Drawing Sheet

SPORTS PROTECTION GARMENT

BACKGROUND OF THE INVENTION

1. Technical Field

This device relates to padded protective garments worn by athletes involved in high contact sports, such as football.

2. Description of the Prior Art

Prior Art devices of this type have proposed and used a variety of protective pads positioned in garments carrying same. Independent pads have been developed to protect special areas of the athlete, such as the should pad, etc. Multiple padded garments have relied on fixed pads of dense resilient material affixed within the garment, see for example U.S. Pat. Nos. 3,135,961, U.S. Pat. No. 4,507,801 and U.S. Pat. No. 4,642,814 and foreign Patent No. DE010842.

In U.S. Pat. No. 3,135,961 a protective garment for athletes is disclosed having a pullover shirt configuration with a large pad of an elastomer sponge material in a pocket. The single pad covers the front chest area of the garment only.

In U.S. Pat. No. 4,507,801 a protective garment is shown having a multiplicity of pockets into which are positioned resilient pads which are made from a sandwich layer configuration within internal layer of rigid polycarbonates. The pads are positioned about the garment with multiple pads adjacent one another over and on each shoulder configuration.

U.S. Pat. No. 4,642,814 is directed to an athletic padding wherein numerous disk shaped pads of resilient material are encapsulated in a flexible material such as vinyl or neoprene.

In foreign Patent No. DE010842 a safety garment for skiers and climbers is shown having inflatable air pockets with pressurized cylinder interconnected thereto during danger. The inflation of the pads cushions the body and prevents crushing associated with being buried by an avalanche of snow or the like. A life line is also provided extending from the garment for ease of location of the victim.

SUMMARY OF THE INVENTION

A sport protection garment to protect an athlete's upper body by cushioning it with a plurality of self-contained multiple chambered shock absorbing air inflated pads. Each pad can be replaced upon damage and has a multiple valve configuration to distribute captured air within absorbing and regulating the severity of the impact to one part of the pad and therefore the body.

DESCRIPTION OF THE PREFERRED EMBODIMENT

Figure 1:
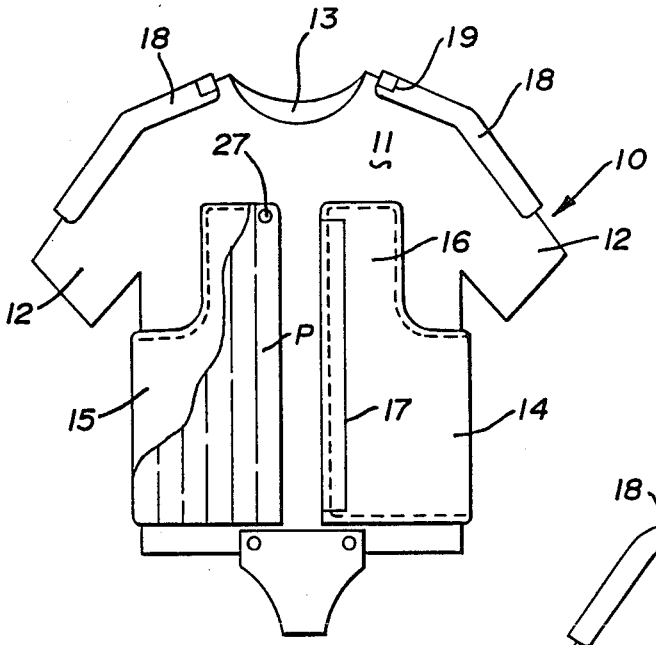
FIG. 1 is a front plan view of the garment with a portion broken away revealing an enclosed inflatable pad.
Figure 2:
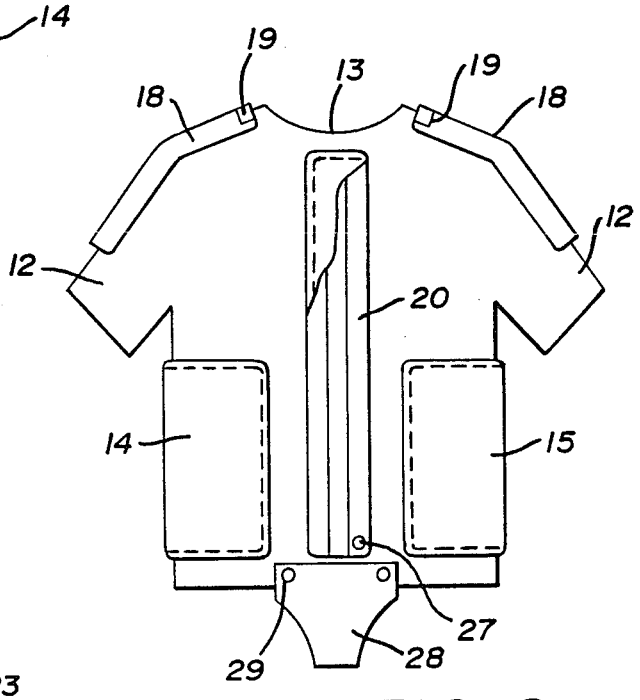
FIG. 2 is a back plan view of the garment with a portion broken away revealing an enclosed inflatable pad.

A sports protection garment can be seen in FIGS. 1 and 2 of the drawings comprising a lightweight shirt 10 of fabric material configured to fit the upper body of any athlete with a main body 11, oppositely disposed arms 12 and a neck opening 13. On the main body 11 of the shirt 10 are formed two spaced oppositely disposed matching receptacle pockets 14 and 15. Each of the receptacle pockets have a generalized rectangular configuration extending around a portion of the main body 11 under the arms 12 and to the back of the shirt, seen in FIG. 2 of the drawings. Each of the receptacle pockets has an outwardly extending tab portion 16 at one end thereof that extends vertically towards the neck opening 13, best seen in FIG. 1 of the drawings. The receptacle pockets are secured around their perimeter edge by sewing or the like. An access flap 17 is provided on each of the receptacle pockets 14 and 15 extending vertically just inwardly from one of its perimeter edges. The access flap 17 provides an opening into which access to the receptacle pocket can be gained.

A pair of identical shoulder pockets 18 are formed along the upper portion of the arms 12 extending from the neck opening 13 just inwardly of the arms 12. Each of the shoulder pockets 18 is secured around its perimeter edge to the shirt and has an access flap 19.

Figure 3:
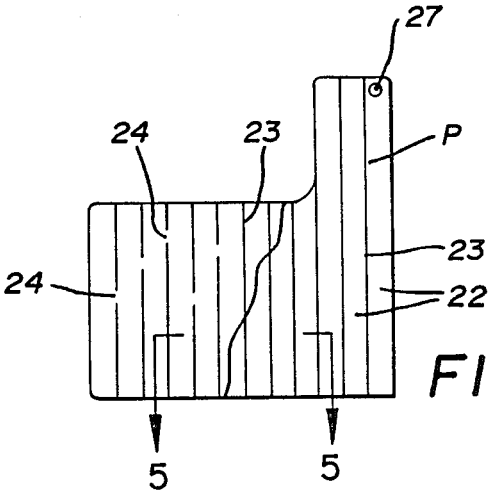
FIG. 3 is a front plan end view of an inflatable pad of the invention.
Figure 5:
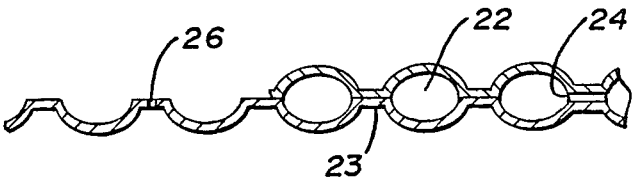
FIG. 5 is an enlarged cross-sectional view on lines 5—5 of FIG. 3.
Figure 4:
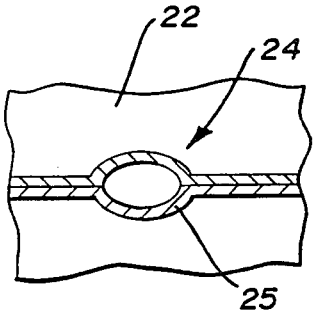
FIG. 4 is an enlarged cross-sectional view of a portion of an inflated pad showing the valve configuration formed between multiple chambers.

Referring now to FIG. 2 of the drawings an elongated spinal pocket 20 is seen extending vertically between the receptacle pockets 14 to the neck opening 13. An access flap 21 extends transversely across one end thereof for access to same. Each of the before mentioned pockets are designed to received a matching inflatable pad P configured in the same outside exterior surface configuration as the pockets, but slightly smaller so as to facilitate insertion within. Each of the inflatable pads P is made up of a plurality of interconnected elongated chambers 22 formed by heat sealing two surfaces of a heat sealable resin base material integrally which are adjacent one another and are in sheet form before sealing. Referring now to FIGS. 3, 4 and 5 of the drawings an inflatable pad P has a portion cut away showing the sealed seams 23 and intermitten spaced no seal areas at 24 (oversized for clarity for illustration purposes only). Each of the non-sealed areas at 24 can best be seen in FIG. 4 of the drawings as a valve opening 25 which is dependent and adjustable in relation to air pressure within. Each of the numerous non-sealed areas defining a valve opening 25 regulates the distribution of air between the chambers 22 during impact regulating the amount of air to adjacent chambers dissipating the impact forced by absorbing the kinetic energy of the impact and transferring same to a wide area of expanding adjacent chambers 22. Each of the sealed seams 23 are slit at 26, seen in FIG. 5 of the drawings, allowing for increased flexibility between the adjacent chambers 22. Each of the inflated pads P has a central inflation stem valve 27 for inflating of same.

In operation the pockets 14, 18 and 20 receive their registering inflatable pads P as hereinbefore described. The shirt is worn by the athlete and secured by a support strap 28 extending from the lower front to the lower back and held in place by a plurality of spaced oppositely disposed transversely positioned snaps 29.

Should a inflatable pad P be ruptured during use it can be removed and repaired or replaced by a replacement pad which can be inserted into the pocket in place thereof.

Thus, it will be seen that a new and useful sports protection garment has been illustrated ad described and it will be apparent to those skilled in the art that various changes and modifications may be made therein without departing from the spirit of the invention. Therefore,

I claim:

1. A sports protection garment of lightweight material comprising a shirt having a neck opening, oppositely disposed arms thereon, a plurality of paired receptacle pockets positioned on said shirt, an elongated spinal pocket positioned between one of said pairs of receptacle pockets, each of said pockets having an access flap thereon, a multi-chambered inflatable pad within each of said pockets, said chambers formed by intermitten sealed seams slit within their sealed portions, a plurality of spaced nonaligned valve openings between said chambers, means for inflation of said inflatable pads.

2. The sport protection garment of claim 1 wherein one of said paired receptacle pockets are positioned individually on the garment extending from said neck opening along each of said arms.

3. The sport protection garment of claim 1 wherein said means for inflation of said inflatable pad comprises an inflation stem valve in one of said chambers and a source of fluid.

* * * * *